US012747859B2

(12) United States Patent
Laroche et al.

(10) Patent No.: US 12,747,859 B2
(45) Date of Patent: Sep. 29, 2026

(54) CLC METHOD AND PLANT WITH RECOVERY OF GASEOUS OXYGEN PRODUCED BY AN OXYGEN CARRIER

(71) Applicants: IFP ENERGIES NOUVELLES, Rueil-Malmaison Cedex (FR); TOTALENERGIES ONETECH, Courbevoie (FR)

(72) Inventors: Catherine Laroche, Rueil-Malmaison Cedex (FR); Florent Guillon, Rueil-Malmaison Cedex (FR); Airy Tilland, Rueil-Malmaison Cedex (FR)

(73) Assignees: IFP ENERGIES NOUVELLES, Rueil-Malmaison (FR); TOTALENERGIES ONETECH, Courbevoie (FR)

( * ) Notice: Subject to any disclaimer, the term of this patent is extended or adjusted under 35 U.S.C. 154(b) by 371 days.

(21) Appl. No.: 18/291,012

(22) PCT Filed: Jul. 4, 2022

(86) PCT No.: PCT/EP2022/068466
§ 371 (c)(1),
(2) Date: Jan. 22, 2024

(87) PCT Pub. No.: WO2023/001535
PCT Pub. Date: Jan. 26, 2023

(65) Prior Publication Data

US 2024/0271780 A1 Aug. 15, 2024

(30) Foreign Application Priority Data

Jul. 23, 2021 (FR) ..... 2108030

(51) Int. Cl.
*F23C 10/04* (2006.01)
*F23C 9/06* (2006.01)
(Continued)

(52) U.S. Cl.
CPC ..... *F23C 10/04* (2013.01); *F23C 9/06* (2013.01); *F23C 10/10* (2013.01); *F23C 99/00* (2013.01);
(Continued)

(58) Field of Classification Search
CPC .. F23C 10/04; F23C 99/00; F23C 9/00; F23C 9/06; F23C 10/10; F23C 2206/10;
(Continued)

(56) References Cited

U.S. PATENT DOCUMENTS 3,587,600 A 6/1971 Bremshey et al.
8,318,101 B2 11/2012 Morin et al.
(Continued)

FOREIGN PATENT DOCUMENTS

FR 2895413 A1 6/2007
FR 2983488 A1 6/2013
FR 3004126 A1 10/2014

OTHER PUBLICATIONS

International Search report PCT/EP2022/0868466 dated Nov. 2, 2022 (pp. 1-2).

*Primary Examiner* — Alfred Basichas
(74) *Attorney, Agent, or Firm* — Csaba Henter; MILLEN, WHITE, ZELANO & BRANIGAN

(57) ABSTRACT

The present invention concerns a CLC method and plant for a hydrocarbon feedstock, comprising combustion of said hydrocarbon feedstock (8) on contact with an oxygen carrier in form of particles in a reduction zone (R0), and oxidation of the oxygen carrier from reduction zone (R0) on contact with an oxidizing gas, preferably air, in an oxidation zone. According to the invention, gaseous oxygen is released by the oxygen carrier in a sealing device (S1) operating in a dual fluidized bed and positioned in the path of said carrier from the oxidation zone to the combustion zone, and it is
(Continued)

mixed with part of the combustion fumes intended to be recycled to the reduction zone. The gaseous oxygen then enables combustion of the residual unburned species that may be contained in the combustion fumes and/or it participates in the combustion of the hydrocarbon feedstock in the reduction zone.

20 Claims, 3 Drawing Sheets

(51) Int. Cl.
*F23C 10/10* (2006.01)
*F23C 99/00* (2006.01)
*F23L 7/00* (2006.01)

(52) U.S. Cl.
CPC ..... *F23L 7/007* (2013.01); *F23C 2206/10* (2013.01); *F23C 2900/10001* (2013.01); *F23C 2900/10002* (2013.01); *F23C 2900/99008* (2013.01)

(58) Field of Classification Search
CPC .. F23C 2900/10001; F23C 2900/10002; F23C 2900/99008; F23L 7/007
See application file for complete search history.

(56) References Cited

U.S. PATENT DOCUMENTS

| | | | | |
|---|---|---|---|---|
| 9,004,911 | B1 | 4/2015 | Siriwardane et al. | |
| 9,494,315 | B2 | 11/2016 | Guillou et al. | |
| 9,726,369 | B2 * | 8/2017 | Gauthier | F23C 99/00 |
| 9,927,118 | B2 | 3/2018 | Gauthier et al. | |
| 10,184,657 | B2 | 1/2019 | Yazdanpanah et al. | |
| 10,317,072 | B2 | 6/2019 | Yazdanpanah et al. | |
| 11,071,971 | B2 | 7/2021 | Lambert et al. | |
| 11,717,811 | B2 | 8/2023 | Lambert et al. | |
| 2016/0061442 | A1 * | 3/2016 | Yazdanpanah | B01J 8/007 431/170 |
| 2017/0320731 | A1 * | 11/2017 | Sozinho | C01B 3/42 |
| 2017/0321886 | A1 * | 11/2017 | Guillou | B01J 8/065 |
| 2017/0321887 | A1 * | 11/2017 | Yazdanpanah | F23C 10/01 |

* cited by examiner

CLC METHOD AND PLANT WITH RECOVERY OF GASEOUS OXYGEN PRODUCED BY AN OXYGEN CARRIER

FIELD OF THE INVENTION

The present invention concerns the field of hydrocarbon feedstock combustion by redox-based chemical looping combustion (CLC) in a fluidized bed, and more particularly a CLC method and plant exploiting the gaseous oxygen produced by an oxygen carrier by CLOU effect.

BACKGROUND OF THE INVENTION

Fighting greenhouse gas emissions involves, among the panel of technical solutions proposed, capture of the gases resulting from the combustion of hydrocarbon feedstocks such as $CO_2$. Chemical looping combustion is not only one of the technologies with the lowest capture energy penalty, it is also a $CO_2$ capture technology particularly suited for combustion of solid feedstocks difficult to treat by conventional combustion methods, such as pulverized solid feedstock combustion.

A CLC method consists in carrying out redox reactions of an active mass, typically a metal oxide, so that the combustion reaction of a hydrocarbon feedstock decomposes into two successive reactions: a first reaction of oxidation of the active mass on contact with an oxidizing gas, typically air, in at least one oxidation zone, and a second reaction of reduction of the active mass on contact with the feedstock whose combustion is desired, in at least one combustion zone.

The redox active mass, which yields part of the oxygen it contains on contact with the feedstock in the combustion zone, thus acts as an oxygen carrier between said combustion zone and the oxidation zone where it is again oxidized. It is commonly referred to as "oxygen carrier".

This solid material comes in form of fluidizable particles, of size typically ranging between 50 and 500 μm. The particles are contacted in the reaction zones, with either the oxidizing gas or the feedstock, in form of high-temperature fluidized beds, and they are generally transported from one zone to the other in fluidized form. All of the particles transported in fluidized form are commonly referred to as "circulating fluidized bed".

These particles are oxidized on contact with an oxidizing gas, typically air (or water vapor), in at least a first reaction zone referred to as oxidation zone or oxidation reactor, or air reactor. They are subsequently transported into at least a second reaction zone, referred to as reduction zone or reduction reactor, combustion reactor or fuel reactor, where they are contacted with a hydrocarbon feedstock whose combustion is to be carried out. The feedstock can be solid (e.g. coal), liquid (e.g. fuel), or gaseous (e.g. natural gas). The oxygen contained in the active mass particles transported from the oxidation zone to the reduction zone feeds the feedstock combustion. The result is a gaseous effluent formed by the feedstock combustion, commonly referred to as combustion fumes, and a stream of reduced particles. The particles are sent back to the air reactor to be reoxidized, thus closing the loop.

The oxidation and combustion reactors operate in fluidized beds. They each comprise at least one system for injecting a fluidizing gas. In the combustion reactor, the fluidizing gas is typically $CO_2$, which may be $CO_2$ produced upon combustion and recycled, or water vapor. In the oxidation reactor, the fluidizing gas is an oxidizing gas, typically air.

The CLC method allows to produce energy (for example in form of vapor, electricity, etc.) by recovering the heat released by combustion reactions, while facilitating capture of the carbon dioxide ($CO_2$) emitted upon combustion through the production of $CO_2$-rich fumes. Capture of the $CO_2$ can be done after condensation of the water vapor and compression of the fumes, and it can then be stored, in a deep aquifer for example, or recovered, for example by using it in order to improve the oil production efficiency in enhanced oil (EOR) or gas (EGR) recovery processes.

The CLC method can also enable the production of syngas, or even hydrogen, by controlling the combustion and by carrying out the required purifications downstream from the combustion process.

This particular chemical looping combustion method also has the advantage of producing a stream very rich in nitrogen, which is the depleted air obtained after oxidation of the active mass in the air reactor. Depending on the degree of purity reached, this nitrogen stream can be upgraded in various applications, notably in the petroleum industry. It can for example be used in refineries as inert gas in various oil refining processes or for the treatment of produced water, or as gas injected into the subsoil in EOR processes.

Conversion of the gaseous hydrocarbon feedstocks in the fuel reactor involves a gas/solid reaction between said gaseous feedstocks and the oxygen carrier that may be limiting for the process. In the case of solid hydrocarbon feedstocks, an additional gasification step is required for converting the solid feedstock to gaseous species (production of syngas CO and $H_2$) reacting with the oxygen carrier. If the feedstock used thus is a solid feedstock, the gasification step can be (temporally) limiting. In the case of liquid hydrocarbon feedstocks, a step of liquid feedstock vaporization and of coke formation on the oxygen carrier generally occurs in the fuel reactor. Again, this liquid vaporization and coke formation step, and gasification of the coke, can be limiting.

To overcome these limitations, in particular in the case of combustion of solid or gaseous hydrocarbon feedstocks, it has been proposed in the literature, for example by Mattisson et al., 2009 ("Chemical looping with oxygen uncoupling for combustion of solid fuels", Int. Journal of greenhouse gas control 3, 2009, pp. 11-19), to use oxygen carriers capable of releasing gaseous oxygen (dioxygen in gas form). Combustion processes using this type of oxygen carrier are referred to as Chemical Looping combustion processes with Oxygen Uncoupling (CLOU). Typically, CLOU processes are based on chemical looping combustion (CLC) and they involve three steps in two reactors, an air reactor where the oxygen carrier is oxidized on contact with air (step 1), and a fuel reactor where the carrier releases the gaseous oxygen (step 2) and where this gaseous oxygen reacts with the hydrocarbon feedstock (step 3). Thus, with such oxygen carriers, it is possible to carry out gas/gas reactions directly between the gaseous oxygen released by the oxygen carrier and the reactants in gas form (gaseous species produced by devolatilization and/or gasification of the hydrocarbon feedstock when it is solid or liquid), and thus to increase the hydrocarbon feedstock conversion rates. Moreover, in the case of combustion of solid hydrocarbon feedstocks, the released oxygen can react directly with the solid feedstocks prior to gasification (conventional combustion).

Perovskites, copper, cobalt or manganese oxides, mixed iron-cobalt or iron-manganese oxides are for example among the materials with good oxygen release properties, as described in Mattisson et al., 2009, or Shafiefarhood et al., 2015 ("Iron-containing mixed-oxide composites as oxygen carriers for CLOU", Fuel 139, 2015, pp. 1-10). According to Mattisson et al., 2009, for example, using oxygen carrier materials releasing gaseous oxygen would allow to increase the rate of conversion of solid hydrocarbon feedstocks by up to 50 times. The specific feature of these oxygen carriers capable of releasing gaseous oxygen, which may be referred to as "CLOU effect oxygen carriers" here, is that a portion only of the oxygen available in the material is released in gas form. The rest of the oxygen of the oxygen carrier reacts with the hydrocarbon feedstock contacted with the oxygen carrier, through a gas/solid reaction. The gaseous oxygen is released very rapidly by the oxygen carrier when it is in an inert atmosphere, which is an undeniable advantage for its use in the context of combustion of a hydrocarbon feedstock.

In a conventional CLC process, the oxygen carrier can be exposed for a significant period of time, typically a few minutes, to an inert atmosphere, i.e. an atmosphere consisting of nitrogen, $CO_2$ or water vapor, alone or in admixture, between the air and fuel reactors. Depending on the nature of the oxygen carrier used, this exposure may result in the release of part of the oxygen of the oxygen carrier by CLOU effect, which is conventionally not exploited in the CLC process.

Patent EP-3,158,264 discloses a CLC method wherein the oxygen carrier is sent to a heat exchanger operating in a dense fluidized bed, positioned between the air reactor and the fuel reactor, where heat recovery is controlled by varying the fluidized bed level, by applying a pressure drop on a fluidizing gas outlet at the top of the heat exchanger. The residence time, in the heat exchanger, of the oxygen carrier from the air reactor can enable spontaneous gaseous oxygen release by CLOU effect if it is at low $O_2$ partial pressure, and this gaseous oxygen can be used in the reduction zone for combustion of the feedstock. However, it is not specified how this gaseous oxygen would be used. Besides, control of the operating conditions in the heat exchanger is specific to the bed level control to ensure the desired heat exchange. The inventory of the oxygen carrier solid in the heat exchanger is thus variable depending on the level of the bed. Similarly, selecting the section of the exchanger enclosure is dictated by the heat exchange surface area with the carrier, which may lead to implement a very significant fluidization, and therefore to dilute the oxygen released by CLOU effect, thus making its exploitation less efficient.

Patent U.S. Pat. No. 9,004,911 relates to a chemical looping combustion method for a solid hydrocarbon feedstock, using a specific fuel reactor allowing to benefit from the CLOU effect of the oxygen carrier material. According to this method, there is no direct contact between the oxygen carrier and the solid feedstock: the fuel reactor is divided into two parts separated by a porous wall allowing passage of the gas. The oxidized oxygen carrier is fed into one of the parts, and the solid hydrocarbon feedstock is fed into the other where it is volatilized, and possibly gasified by feeding a gasification agent ($CO_2$ and/or $H_2O$). The reducing gases produced by gasification flow through the porous wall, thus creating a reducing atmosphere providing reduction of the oxygen carrier, and thus ensuring combustion of the gasified feedstock. At the same time, gaseous oxygen produced by the carrier can pass through the wall and provide combustion of the reducing gases in the part containing the solid feedstock. An equilibrium thus occurs, which enables conversion of the solid feedstock without direct contact with the oxygen carrier. However, gasification of the solid feedstock requires significant heat supply, which, in a conventional CLC method, is provided by the oxygen carrier. The method according to U.S. Pat. No. 9,004,911, where the oxygen carrier is not in contact with the solid feedstock, therefore has the major drawback of not taking full advantage of the heat supplied by the oxygen carrier. Another drawback of this method lies in the use of a large-size porous wall at the heart of a reactor at very high temperature, which is a technological challenge.

Patent CN-102,200,277 also discloses a chemical looping combustion method for a solid hydrocarbon feedstock, wherein the gaseous oxygen is supplied to the feedstock, but without contact with the oxygen carrier, through the use of a porous wall. The drawbacks of such a method are substantially identical to those discussed above for the method according to U.S. Pat. No. 9,004,911: a complex technology to implement, notably related to the installation of one reactor within another, the high combustion temperatures, and a problem of supplying the heat necessary for gasification without direct contact between the oxygen carrier and the feedstock.

There is therefore a need to improve CLC methods, notably in order to provide CLC methods capable of treating all kinds of feedstocks, including solid feedstocks for which complete combustion is more difficult to obtain, which are simple, efficient regarding the feedstock conversion level, while reducing the energy expenses and, in fine, the operating costs, and/or while limiting the residence time of the reactants in the reaction zones, which can notably make it possible to use more compact fuel reactors, and in fine to reduce the investment costs.

It would therefore be advantageous to provide a CLC method wherein the gaseous oxygen released by the oxygen carrier can be exploited.

SUMMARY OF THE INVENTION

In this context, the present invention aims to overcome, at least partly, the problems of the prior art discussed above.

In general terms, the present invention aims to provide a CLC method and plant allowing to recover gaseous oxygen released by the oxygen carrier by CLOU effect so as to use it in the CLC method and plant, while enabling part of the combustion fumes to be recycled for fluidization of the fuel reactor.

The CLC method and plant according to the invention allow the operating costs to be reduced, notably by limiting the need for external utilities such as, for example, the oxygen used for combustion of the residual unburned species that can be found in the combustion fumes to be recycled, or the water vapor used as fluidizing gas. Conversion of the hydrocarbon feedstock is also faster if the gaseous oxygen recovered is used in the fuel reactor.

Although they apply to any type of hydrocarbon feedstock, whether in gas, solid or liquid form, the CLC method and plant according to the present invention are particularly suited to the combustion of solid feedstocks producing solid unburned residues, and combustion fumes that may more frequently contain residual unburned species.

Thus, in order to achieve at least one of the aforementioned goals, among others, the present invention provides, according to a first aspect, a method for the combustion of a hydrocarbon feedstock by redox-based chemical looping combustion wherein a redox active mass in form of particles circulates between an oxidation zone and a reduction zone operating in a fluidized bed, comprising:

combustion of the hydrocarbon feedstock through contact with the redox active mass in the reduction zone, oxidation of the redox active mass from said reduction zone through contact with an oxidizing gas, preferably air, in the oxidation zone, feeding the oxidized redox active mass into at least one sealing device operating in a dual fluidized bed, positioned downstream from said oxidation zone on a transport line carrying said redox active mass to said reduction zone, the sealing device being supplied with at least one neutral fluidizing gas, so as to form at least a first stream comprising at least part of said redox active mass sent to said reduction zone, and a second gaseous stream comprising part of the neutral fluidizing gas and gaseous dioxygen released by the redox active mass, mixing the second gaseous stream with part of the combustion fumes so as to form a combustion fumes recycle stream sent at least partly, after being successively cooled, compressed and heated, to said reduction zone for the fluidized bed operation thereof.

According to one or more embodiments of the invention, part of the combustion fumes contains residual unburned species from the reduction zone, and combustion of said residual unburned species is carried out on contact with the gaseous dioxygen provided by the mixture of said second gaseous stream with said part of the combustion fumes.

According to one or more embodiments of the invention, the method comprises injecting fresh dioxygen into said part of the combustion fumes to complete the combustion of said residual unburned species.

According to one or more embodiments of the invention, the method comprises sending part of the combustion fumes recycle stream, after successive cooling, compression and heating thereof, into the sealing device for the fluidized-bed operation of said sealing device.

According to one or more embodiments of the invention, the gaseous recycle stream is cooled by passing through at least a first heat exchanger, then said cooled combustion fumes recycle stream is compressed in a compressor, and said cooled and compressed combustion fumes recycle stream is heated by passing through said first heat exchanger prior to being sent at least partly to the reduction zone.

According to one or more embodiments of the invention, the combustion fumes recycle stream is cooled by passing through a second heat exchanger positioned between the first heat exchanger and the compressor.

According to one or more embodiments of the invention, the combustion fumes recycle stream is cooled to a temperature ranging between 70 °C and 450 °C, preferably ranging between 70 °C and 300 °C, then compressed to a pressure ranging between 0.02 MPa and 0.3 MPa, and heated to a temperature ranging between 300 °C and 950 °C.

According to one or more embodiments of the invention, the second gaseous stream from said sealing device comprises between 1% and 20% by volume of gaseous dioxygen.

According to one or more embodiments of the invention, the redox active mass comprises at least one compound selected from the list consisting of copper oxides, cobalt oxides, manganese oxides, mixed cobalt-iron or manganese-iron oxides, preferably in form of spinels, perovskites, alone or in admixture, and preferably the redox active mass comprises at least one copper or manganese oxide, preferably associated with an alumina, silica, silica-alumina, feldspar support, such as celsiane, slawsonite, anorthite or feldspathoids such as kalsilite.

According to one or more embodiments of the invention, the neutral fluidizing gas sent to the sealing device is essentially made up of water vapor, $CO_2$, or a mixture of $CO_2$ and water vapor comprising between 0 and 2% by volume of $O_2$, preferably less than 2% by volume of $O_2$.

According to one or more embodiments of the invention, the sealing device comprises an enclosure provided with a first zone and a second zone in fluidic communication. The fluidization conditions are different in this first and this second zone, so as to create a distinct fluidized bed in each of the first and second zones. The first zone receives redox active mass particles from the oxidation reactor, and the second zone receives at least part of the redox active mass particles from the first zone that release the gaseous dioxygen discharged in the second gaseous stream through an outlet pipe arranged at the top of said second zone.

According to one or more embodiments of the invention, a third stream comprising part of said redox active mass is formed and extracted from the bottom of said sealing device in order to be again sent to the oxidation zone.

According to one or more embodiments of the invention, the redox active mass sent to the sealing device is first separated from the oxygen-depleted oxidizing gas from the oxidation zone in a cyclone positioned between the oxidation zone and the sealing device.

According to one or more embodiments of the invention, the hydrocarbon feedstock is a solid feedstock in form of particles, preferably selected from the list consisting of coal, coke, petcoke, biomass, oil sands and domestic waste, and the method further comprises:

separation, in a fluidized-bed solid/solid separator positioned at the reduction zone outlet, between the particles of said redox active mass and unburned particles generated by the combustion of said solid hydrocarbon feedstock contained in a first gas-solid mixture from said reduction zone, the solid/solid separator operating in a fluidized bed, then separation, in a gas/solid separator positioned downstream from the solid/solid separator, between the unburned particles and the gas phase contained in a second gas-solid mixture from the solid/solid separator, a stream comprising the unburned particles being preferably sent to said reduction zone, and the gas phase forming the combustion fumes.

According to a first aspect, the present invention provides a plant for implementing the method for the combustion of a hydrocarbon feedstock by redox-based chemical looping combustion, comprising:

a reduction zone configured to operate in a fluidized bed and to perform combustion of said hydrocarbon feedstock through contact with a redox active mass in form of particles, an oxidation zone configured to operate in a fluidized bed and to perform oxidation of the redox active mass from the reduction zone through contact with an oxidizing gas, preferably air, a transport line for carrying the redox active mass from the oxidation zone to the reduction zone, said transport line comprising a sealing device configured to operate in a dual fluidized bed by means of a neutral fluidizing gas, and to form at least a first stream comprising at least part of the redox active mass sent to the reduction zone and a second gaseous stream comprising part of the neutral fluidizing gas and gaseous dioxygen released by the redox active mass, the sealing device comprising an outlet pipe for the second gaseous stream (6), a recycle line for part of the combustion fumes in the reduction zone, said recycle line being connected to the outlet pipe for the second gaseous stream of the sealing device so as to mix the second gaseous stream with said part of the combustion fumes and to form a combustion fumes recycle stream, and the recycle line comprising a cooling, compression and heating system for the combustion fumes recycle stream before it is sent to the reduction zone.

BRIEF DESCRIPTION OF THE FIGURES

Other features and advantages of the invention will be clear from reading the description hereafter of particular embodiments of the invention, given by way of non-limitative example, with reference to the accompanying figures wherein.

In the figures, the same references designate identical or similar elements.

DETAILED DESCRIPTION OF THE EMBODIMENTS

Figure 1:
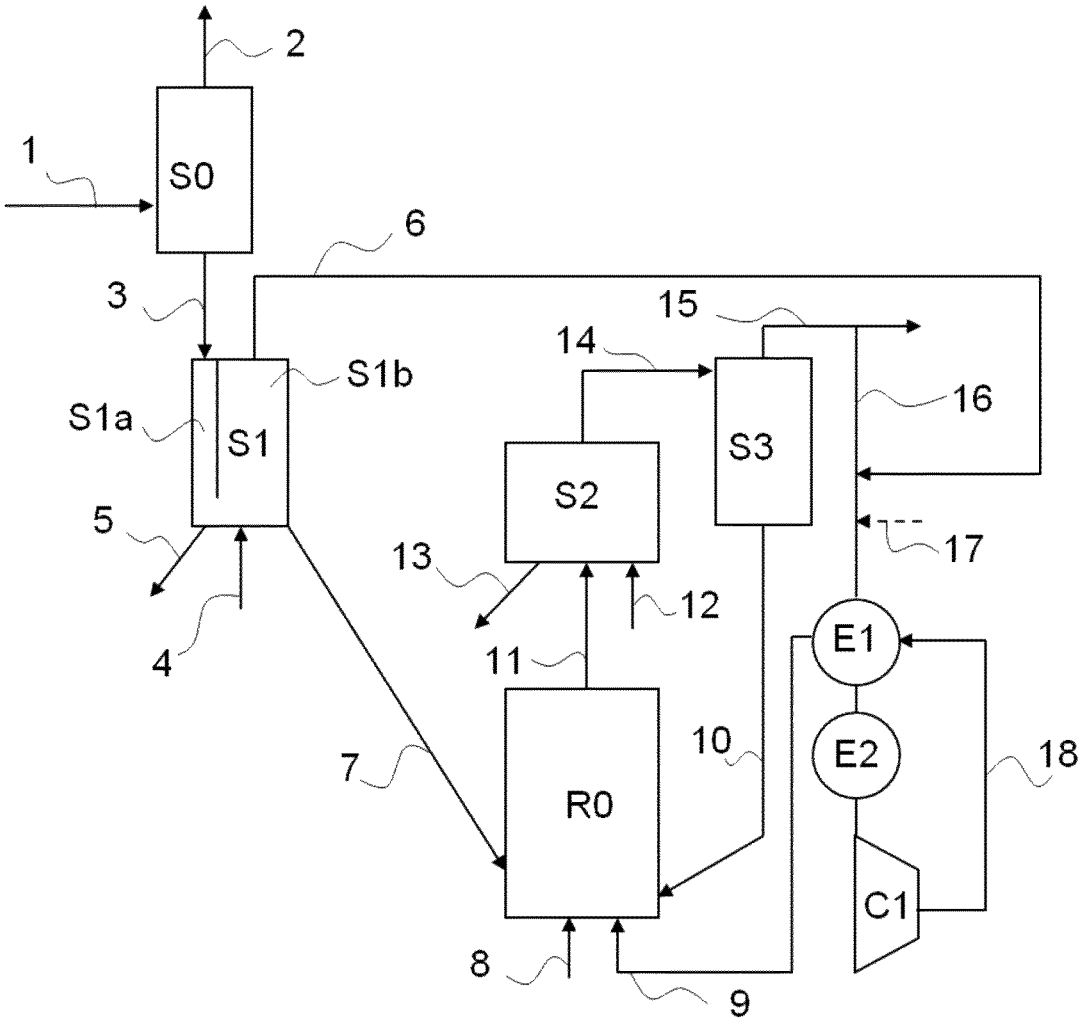
FIG. 1 illustrates the CLC plant and method according to a first embodiment of the invention.

Embodiments of the invention are now described in detail. In the following detailed description, many specific details are exposed in order to provide more thorough understanding of the invention. However, it will be clear to those skilled in the art that the invention can be implemented without these specific details. In other cases, well-known features have not been described in detail in order to avoid making the description unnecessarily complicated.

The present invention concerns a CLC method and a CLC plant implementing such a method, comprising the recovery of gaseous oxygen released by the oxygen carrier in a sealing device positioned in the path of the carrier from the oxidation reactor to the combustion reactor. The recovered gaseous oxygen is mixed with part of the combustion fumes intended to be recycled to the combustion reactor. The gaseous oxygen then enables combustion of residual unburned species from the devolatilization/gasification of a solid feedstock or the non-conversion of a fraction of the gaseous hydrocarbon feedstock that may be contained in the combustion fumes, and/or combustion of the hydrocarbon feedstock in the combustion reactor.

More precisely, the method according to the invention is a method for the combustion of a hydrocarbon feedstock by redox-based chemical looping combustion wherein a redox active mass in form of particles circulates between an oxidation zone and a reduction zone operating in a fluidized bed, comprising:

combustion of the hydrocarbon feed through contact with the redox active mass in the reduction zone, oxidation of the redox active mass from said reduction zone through contact with an oxidizing gas, preferably air, in the oxidation zone, feeding the oxidized redox active mass into at least one sealing device operating in a dual fluidized bed, positioned downstream from said oxidation zone on a transport line carrying said redox active mass to said reduction zone, the sealing device being supplied with at least one neutral fluidizing gas, so as to form at least a first stream comprising at least part of said redox active mass sent to said reduction zone, and a second gaseous stream comprising part of the neutral fluidizing gas and gaseous dioxygen released by the redox active mass, mixing the second gaseous stream with part of the combustion fumes so as to form a combustion fumes recycle stream sent at least partly, after being successively cooled, compressed and heated, to said reduction zone for the fluidized bed operation thereof.

In the present description, the expressions "oxygen carrier" or "redox active mass" or, in abbreviated form, "active mass", "oxygen carrier material" or "oxygen carrier solid" are equivalent. The redox mass is referred to as active regarding its reactive capacities, in the sense that it is capable of acting as an oxygen carrier in the CLC process by capturing and releasing oxygen.

It can be noted that, in general, the terms oxidation and reduction are used in connection with the respectively oxidized or reduced state of the active mass. The oxidation reactor, also referred to as air reactor, is the one wherein the redox active mass is oxidized, and the reduction reactor, also referred to as fuel reactor or combustion reactor, is the reactor wherein the redox active mass is reduced. The reactors operate in a fluidized bed, and the active mass circulates between the oxidation reactor and the reduction reactor. The circulating fluidized bed technology is used to allow continuous change of the active mass from its oxidized state in the oxidation reactor to its reduced state in the reduction reactor.

Gaseous oxygen is understood to be molecular oxygen or dioxygen ($O_2$).

In the rest of the description and in the claims, the positions ("bottom", "top", "above", "under", "horizontal", "vertical", "lower half", etc.) of the various elements are defined with respect to the devices in their operating position.

The CLC Method and Plant According to the Invention

Before further describing the CLC method and plant according to the invention, the principle of chemical looping combustion, which applies within the context of the present invention, is reminded hereafter.

In the CLC method, the oxygen carrier in particle form circulates between at least a reduction zone and an oxidation zone, both operating in a fluidized bed.

The hydrocarbon feedstock treated can be a solid, liquid or gaseous hydrocarbon feedstock: gaseous (e.g. natural gas, syngas, biogas, shale gas), liquid (e.g. fuel oil, bitumen, diesel oil, gasolines, shale oil, etc.) or solid (e.g. coal, coke, petcoke, biomass, oil sands, domestic waste, etc.) fuels.

The CLC method and plant according to the invention are particularly suited to the combustion of a solid hydrocarbon feedstock, although they are not limited to solid feedstocks. Indeed, the CLC method and plant according to the invention allow recovery of the gaseous oxygen that can be used for the combustion of residual unburned species contained in the combustion fumes recycled to the reduction zone. These residual unburned species result from a combustion that is not totally complete in the reduction zone, which is more frequent in the case of solid feedstock combustion.

The operating principle of the CLC method according to the invention is as follows: a reduced oxygen carrier solid is contacted with an air stream, or any other oxidizing gas, in a reaction zone referred to as oxidation zone or air reactor (or oxidation reactor). This results in a depleted air stream (or an oxygen-depleted oxidizing gaseous stream) and a stream of oxidized oxygen carrier particles. The stream of oxidized oxygen carrier particles is transferred to a reduction zone also referred to as fuel reactor (or reduction reactor or combustion reactor). The particle stream is contacted with a fuel, typically a hydrocarbon feedstock as described above, which results in a combustion effluent, also commonly referred to as combustion fumes, and a stream of reduced oxygen carrier particles. The CLC plant can comprise various equipments, for heat exchange, pressurization, gas sealing between the reduction and oxidation zones, separation or possible recirculation of material around the oxidation and reduction zones.

In the reduction zone, the hydrocarbon feedstock is contacted, preferably in a co-current flow, with the oxygen carrier in particle form to achieve combustion of said feedstock by reduction of the oxygen carrier. The oxygen carrier is reduced by means of the hydrocarbon feedstock, which is correlatively oxidized to $CO_2$ and $H_2O$, or possibly to a $CO+H_2$ (syngas) mixture, depending on the oxygen carrier and hydrocarbon feedstock proportions used. Combustion of the feedstock on contact with the oxygen carrier is carried out at a temperature generally ranging between 600 °C and 1200 °C, preferably between 750 °C and 1100 °C, and more preferably between 800 °C and 1100 °C. The contact time may vary depending on the type of hydrocarbon feedstock used. It may typically range between 1 second and 10 minutes, preferably between 1 and 8 minutes for a solid or liquid feedstock, and preferably between 1 and 20 seconds for a gaseous feedstock.

A mixture comprising the gases resulting from combustion (combustion fumes) and the oxygen carrier solid particles is discharged, typically at the top of the reduction zone. Gas/solid separation means such as a cyclone make it possible to separate, on the one hand, the combustion gases and, on the other hand, the solid particles of the oxygen carrier in their most reduced state. The latter are sent to the oxidation zone to be reoxidized, at a temperature generally ranging between 600 °C and 1200 °C, preferably between 750 °C and 1100 °C, and more preferably between 800 °C and 1100 °C.

In the oxidation reactor, the oxygen carrier is restored to its oxidized state on contact with air (or any other oxidizing gas) before returning to the reduction zone, and after being separated from the oxygen-depleted air (or from the oxygen-depleted oxidizing gas) discharged at the top of the oxidation zone.

The oxygen carrier solid, alternately moving from its oxidized form to its reduced form and vice versa, follows a redox cycle.

Reactions (1) and (2) below respectively describe the reduction of the oxygen carrier comprising a metal oxide ($M_xO_y$) generally supported on a ceramic, M representing a metal, on contact with a hydrocarbon feedstock, e.g. a hydrocarbon of formula $C_nH_m$, and its oxidation on contact with an oxidizing gas, air for example.

$$C_nH_m + M_xO_y \longrightarrow n\,CO_2 + m/2\,H_2O + M_xO_{y-2n-m/2} \quad (1)$$

$$M_xO_{y-2n-m/2} + (n + m/4)\,O_2 \longrightarrow M_xO_y \quad (2)$$

In the reduction zone, the oxygen carrier is reduced to the $M_xO_{y-2n-m/2}$ state on contact with the hydrocarbon feedstock that is correlatively oxidized to $CO_2$ and $H_2O$, according to reaction (1), or possibly to a $CO+H_2$ mixture, depending on the nature of the oxygen carrier and the proportions used.

In the oxidation zone, the oxygen carrier is restored to its oxidized state $M_xO_y$ on contact with the oxidizing gas, air for example, according to reaction (2), before returning to the reduction zone.

In cases where oxidation of the oxygen carrier is carried out with water vapor, a hydrogen stream can be obtained at the oxidation reactor outlet, according to reaction (3).

$$M_xO_{y-2n-m/2} + (2n + m/2)H_2O \longrightarrow M_xO_y + (2n + m/2)H_2 \quad (3)$$

The Oxygen Carrier

In addition to the redox properties required for the redox reactions on contact with the hydrocarbon feedstock or the oxidizing gas, and to the features necessary for carrying out fluidization, the oxygen carrier used in the CLC method and plant according to the invention has a capacity to release gaseous oxygen by CLOU effect.

Such oxygen carriers that can be used in the CLC method and plant according to the invention are known, and examples thereof are described in Mattisson et al., 2009, or Shafiefarhood et al., 2015, already mentioned, or in patent applications EP-3,558,518 and EP-3,558,515, or in French patent application filed under Number 20/08.189.

The oxygen carrier preferably consists of metal oxides, such as Cu oxides (e.g. $CuO/Cu_2O$ pair), Co oxides (e.g. $Co_3O_4/CoO$ pair), Mn oxides (e.g. $Mn_2O_3/Mn_3O_4$pair), mixed Co—Fe or Mn—Fe oxides, for example in form of spinels (specific crystalline structures of mixed oxides reproducing the structure of the mineral spinel $MgAl_2O_4$), perovskites (specific crystalline structures of mixed oxides reproducing the structure of the mineral perovskite $CaTiO_3$) such as $CaMnO_3$, alone or in admixture.

Such compounds can come from ores (for example pyrolusite for the Mn oxide) or be synthetic (for example copper oxide particles supported on an alumina or silica-alumina matrix).

They can be combined or not with a binder or a support, such a combination providing notably good reversibility of the oxidation and reduction reactions, and improving the mechanical strength of the particles. Indeed, the metal oxides selected for example from among the Cu, Mn, Co redox pairs, or mixtures thereof, used pure, i.e. without a binder or a support, can show a significant and fast decrease in their oxygen transfer capacity, due to the sintering of the metal particles, as a result of the successive high-temperature oxidation/reduction cycles. Many types of binder and support have been studied in the literature to increase the mechanical strength of the particles. Examples thereof are alumina, metal aluminate spinels, titanium dioxide, titanium dioxide, silica, zirconia, cerin, kaolin, bentonite, perovskites, etc.

Advantageously, the oxygen carrier can comprise at least one manganese or copper oxide, or mixtures thereof, and preferably at least one copper oxide, more preferably combined with a binder or a support, for example a support made of alumina ($Al_2O_3$), silica ($SiO_2$), silica-alumina (mixture of alumina $Al_2O_3$ and silica $SiO_2$), metal aluminates, silicates, aluminum silicates, aluminosilicates, titanium dioxide, perovskites, zirconia, tectosilicates such as feldspars selected from among celsiane, slawsonite, anorthite, or feldspathoids such as kalsilite, or a mixture of a tectosilicate as mentioned above with an oxide as mentioned above (alumina, metal aluminates, silica, silicates, aluminum silicates, aluminosilicates, titanium dioxide, perovskites, zirconia).

According to one or more embodiments, the oxygen carrier can comprise at least one manganese or copper oxide, preferably at least one copper oxide, preferably combined with a support, more preferably a support made of alumina ($Al_2O_3$), silica ($SiO_2$), silica-alumina (mixture of alumina $Al_2O_3$ and silica $SiO_2$), feldspars such as celsiane, slawsonite, anorthite, or feldspathoids such as kalsilite.

According to one or more embodiments, the oxygen carrier can comprise at least one manganese oxide, and it consists for example of pyrolusite, which is a natural variety (ore) of manganese dioxide, $MnO_2$, also known as manganese oxide (IV).

According to one or more embodiments, the oxygen carrier may comprise and may preferably consist of alumina-supported copper oxide ($CuO/Al_2O_3$).

The oxygen carrier particles combining one or more metal oxides and a support can have a specific initial porosity (before any use in the CLC process) that plays a role in the oxygen carrier performances, notably by improving the lifetime of the particles in the CLC process. This is for example the case with the oxygen carriers disclosed in patent applications EP-3,558,515 and EP-3,558,518, and described below.

According to one or more embodiments, the oxygen carrier may comprise and may preferably consist, as described in patent application EP-3,558,515, of copper oxide, preferably forming between 5% and 75% by weight of said oxygen carrier, and a ceramic support within which the copper oxide is dispersed, preferably forming between 25% and 95% by weight of said oxygen carrier, and consisting of calcium aluminate ($CaAl_2O_4$), silica ($SiO_2$), titanium dioxide ($TiO_2$), perovskite ($CaTiO_3$), alumina ($Al_2O_3$), zirconia ($ZrO_2$), yttrium dioxide ($Y_2O_3$), barium zirconate ($BaZrO_3$), magnesium aluminate ($MgAl_2O_4$), magnesium silicate ($MgSi_2O_4$), or lanthanum oxide ($La_2O_3$), preferably alumina or a mixture of alumina and silica. The porosity of such a carrier is such that the total pore volume ranges between 0.05 and 1.2 ml/g, preferably between 0.1 and 0.85 ml/g, the pore volume of the macropores represents at least 10% and preferably at least 40% of the total pore volume of the oxygen carrier; and the macropore size distribution in the oxygen carrier ranges between 50 nm and 7 μm, preferably between 50 nm and 3 μm. Such an oxygen carrier is efficient in terms of oxygen transfer capacity, reactivity with the various hydrocarbon feedstocks likely to be treated, and mechanical strength. In particular, it has a significant lifetime allowing the investment and/or operating costs to be decreased for such processes.

According to one or more embodiments, the oxygen carrier may comprise and may preferably consist, as described in patent application EP-3,558,518, of copper oxide, preferably forming between 5% and 75% by weight of said oxygen carrier, and a ceramic support within which the copper oxide is dispersed, preferably forming between 25% and 95% by weight of said oxygen carrier, and comprising between 60% and 100% by weight of at least one feldspar or one feldspathoid having a melting temperature above 1500 °C, preferably selected from among celsiane, slawsonite, anorthite and kalsilite, more preferably celsiane, and between 0% and 40% of at least one oxide selected from among alumina, metal aluminates, silica, silicates, aluminosilicates, titanium dioxide, perovskites, zirconia. The porosity of such a carrier is such that the total pore volume ranges between 0.05 and 0.9 ml/g, preferably between 0.1 and 0.5 ml/g, the pore volume of the macropores represents at least 10% and preferably at least 50% of the total pore volume of the oxygen carrier; and the macropore size distribution in the oxygen carrier ranges between 50 nm and 7 μm, preferably between 50 nm and 4 μm. Such an oxygen carrier is efficient in terms of oxygen transfer capacity, reactivity with the various hydrocarbon feedstocks likely to be treated, and mechanical strength. In particular, it has a significant lifetime allowing the investment and/or operating costs to be decreased for such processes.

It is reminded that, according to the IUPAC nomenclature, micropores are understood to be pores whose size (opening) is less than 2 nm, mesopores are pores whose size ranges between 2 nm and 50 nm, and macropores are pores whose size is greater than 50 nm.

The total pore volume is understood to be the volume measured by mercury intrusion porosimetry according to the ASTM D4284-83 standard (measurement of the volume of mercury injected when the exerted pressure increases from 0.22 MPa to 413 MPa). The macropore volume is measured by mercury intrusion porosimetry according to the same standard (the value from which the mercury fills all the intergranular voids is set at 0.2 MPa, and one considers that, beyond this value, the pores of the sample are penetrated by the mercury). The macropore size distribution in the particles is measured by mercury porosimetry.

According to one or more embodiments, the oxygen carrier may comprise and may preferably consist, as described in the French patent application filed under Number 20/08.189, of copper with a total content X ranging between 5% and 39% by weight of copper oxide relative to the total weight of the oxygen carrier in oxidized form, and a ceramic support within which the copper is dispersed, the support comprising a first sub-stoichiometric spinel of formula $Mg_aAl_bO_4$, and/or a second sub-stoichiometric spinel of formula $Cu_cMg_dAl_eO_4$, with a, b, c, d and e described according to the following formulas:

$$a = 4/\left[1 + \left(3 * \left(\left((100 - X)/Y\right) - 1\right)\right) \times M_{MgO}/M_{Al2O3}\right],$$

$$b = (8 * (100\text{-}X\text{-}Y))/\left[Y * M_{Al2O3}/M_{MgO} + 3 \times (100 - X\text{-}Y)\right],$$

$$c = (4 * X)/\left[M_{CuO} * \left(\left(X/M_{CuO}\right) + \left(Y/M_{MgO}\right) + 3 * (100 - X\text{-}Y)/M_{Al2O3}\right)\right],$$

$$d = (4 * Y)/\left[M_{MgO} * \left(\left(X/M_{CuO}\right) + \left(Y/M_{MgO}\right) + 3 * (100 - X\text{-}Y)/M_{Al2O3}\right)\right],$$

$$e = (8 * (100 - X - Y))/\left[M_{Al2O3} * \left(\left(X/M_{CuO}\right) + \left(Y/M_{MgO}\right) + 3 * (100 - X\text{-}Y)/M_{Al2O3}\right)\right],$$

$M_{MgO}$, $M_{CuO}$, $M_{Al2O3}$ being the respective molar masses of MgO, CuO and $Al_2O_3$, Y being the amount of MgO in percentage weight of oxygen carrier, with X ranging between 5% and 39%, Y ranging between 1% and 23%, and $Y < -0.6342X + 26.223$. Such an oxygen carrier is another example of a carrier with good mechanical strength, which provides a significant lifetime, thus allowing the investment and/or operating costs of the process to be decreased, while being efficient in terms of oxygen transfer capacity and reactivity with the various types of hydrocarbon feedstocks to be treated.

The oxygen storage capacity of the oxygen carrier can advantageously range, depending on the material type, between 1% and 15% by weight. It is understood to be the mass of oxygen corresponding to the transition between the most reduced state of the oxygen carrier and the most oxidized state thereof, it is for example 10% when related to the mass of CuO used in the case of the $CuO/Cu_2O$ pair. In cases where the oxygen carrier is supported on an inert support, the storage capacity is reduced to the mass of the assembly made up of the support and the active phase, i.e. 3% for the $CuO/Cu_2O$ example if this active phase represents 30% CuO dispersed in a support. Advantageously, the amount of oxygen actually transferred by the metal oxide ranges between 1% and 3% by weight, typically 2% by weight, which allows to only use a fraction of the oxygen storage capacity, ideally less than 30% thereof so as to limit risks of mechanical aging or agglomeration of the particles. In the case of oxygen carriers consisting of a supported active phase, degradation of the mechanical properties and agglomeration of the particles are limited, and it is possible to go higher up in the use of oxygen, up to 100% of the capacity.

Using only a fraction of the oxygen storage capacity also involves the advantage that the fluidized bed acts as a thermal ballast and therefore smoothes the temperature variations along the path through the bed.

According to the invention, the oxygen carrier is capable of releasing part of the oxygen it contains in form of gaseous oxygen under certain conditions in the CLC process, typically when it is subjected to an atmosphere with a low partial pressure of oxygen for a sufficient time. The other part of the oxygen in atomic form in the oxygen carrier can be used during reduction reactions on contact with the hydrocarbon feedstock, which is referred to here as gaseous oxygen release capacity by CLOU effect.

Figure 3:
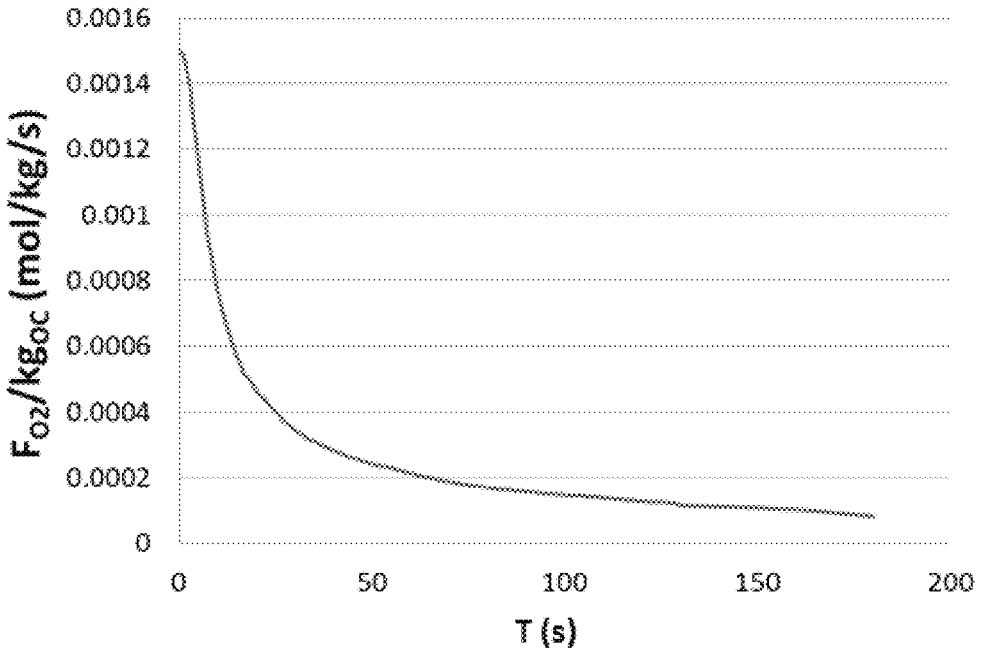
FIG. 3 is an example of a gaseous oxygen release profile by CLOU effect of a manganese oxide-based oxygen carrier.

It is generally possible to experimentally establish a gaseous oxygen release profile as a function of time for a given oxygen carrier, when it is subjected, in the most oxidized form thereof, to an inert atmosphere, typically consisting of nitrogen or rare gases, by measuring the oxygen produced as a function of time. FIG. 3 illustrates for example the gaseous oxygen release profile of an oxygen carrier consisting of manganese oxides, detailed in Example 1.

Typically, the oxygen carrier used in the CLC method and plant according to the invention is capable of releasing gaseous oxygen, in an atmosphere with a low partial pressure of oxygen, i.e. containing between 0% and 2% by volume of oxygen, preferably less than 2% by volume of $O_2$, and more preferably less than 1% by volume of $O_2$, for example pure nitrogen, $CO_2$, water vapor, or a mixture of $CO_2$ and water vapor, under the temperature and pressure conditions of the CLC process, as it is the case, for example, for recycled combustion fumes.

Under such conditions, the oxygen carrier used in the CLC method and plant according to the invention is preferably capable of releasing gaseous oxygen very rapidly. Typically, the major part or even more than 80%, or even 90%, of the gaseous oxygen it can release can be reached after a few minutes, for example between 1 minute and 15 minutes, preferably between 1 minute and 10 minutes, and more preferably between 1 minute and 5 minutes.

An atmosphere referred to as "neutral" or "inert" with respect to the oxygen carrier is understood to be an atmosphere with no possibility of spontaneous chemical reaction, under the test conditions, of the gases it is made up of with the oxygen carrier.

The shape and size of the particles are advantageously suited to a fluidized-bed implementation.

The oxygen carrier can come in form of fluidizable particles belonging to groups A, B or C of the Geldart classification, based on the size of the particles and their density difference with the gas (D. Geldart, "Types of gas fluidization", Powder Technol. 7(5), 1973, pp. 285-292). Preferably, the oxygen carrier particles belong to group A or to group B, more preferably to group B, of the Geldart classification.

Preferably, the particles of the carrier solid are substantially spherical, or they may have any similar shape.

Preferably, the grain size of the oxygen carrier particles is such that more than 90% of the particles have a size ranging between 50 μm and 600 μm, more preferably a grain size such that more than 90% of the particles have a size ranging between 80 μm and 400 μm, even more preferably a grain size such that more than 90% of the particles have a size ranging between 100 μm and 300 μm, and yet more preferably a grain size such that more than 95% of the particles have a size ranging between 100 μm and 300 μm.

The size of the particles can be measured by laser granulometry. The size distribution of the particles of the oxygen carrier solid is preferably measured by means of a laser particle size analyzer, for example the Malvern Mastersizer 3000@, preferably by means of a wet method, and using the Fraunhofer theory.

Preferably, the particles of the oxygen carrier have a grain density ranging between 500 $kg/m^3$ and 5000 $kg/m^3$, preferably a grain density ranging between 800 $kg/m^3$ and 4000 $kg/m^3$, and more preferably a grain density ranging between 1000 $kg/m^3$ and 3000 $kg/m^3$.

Use of the Gaseous Oxygen Released by CLOU Effect

Figure 2:
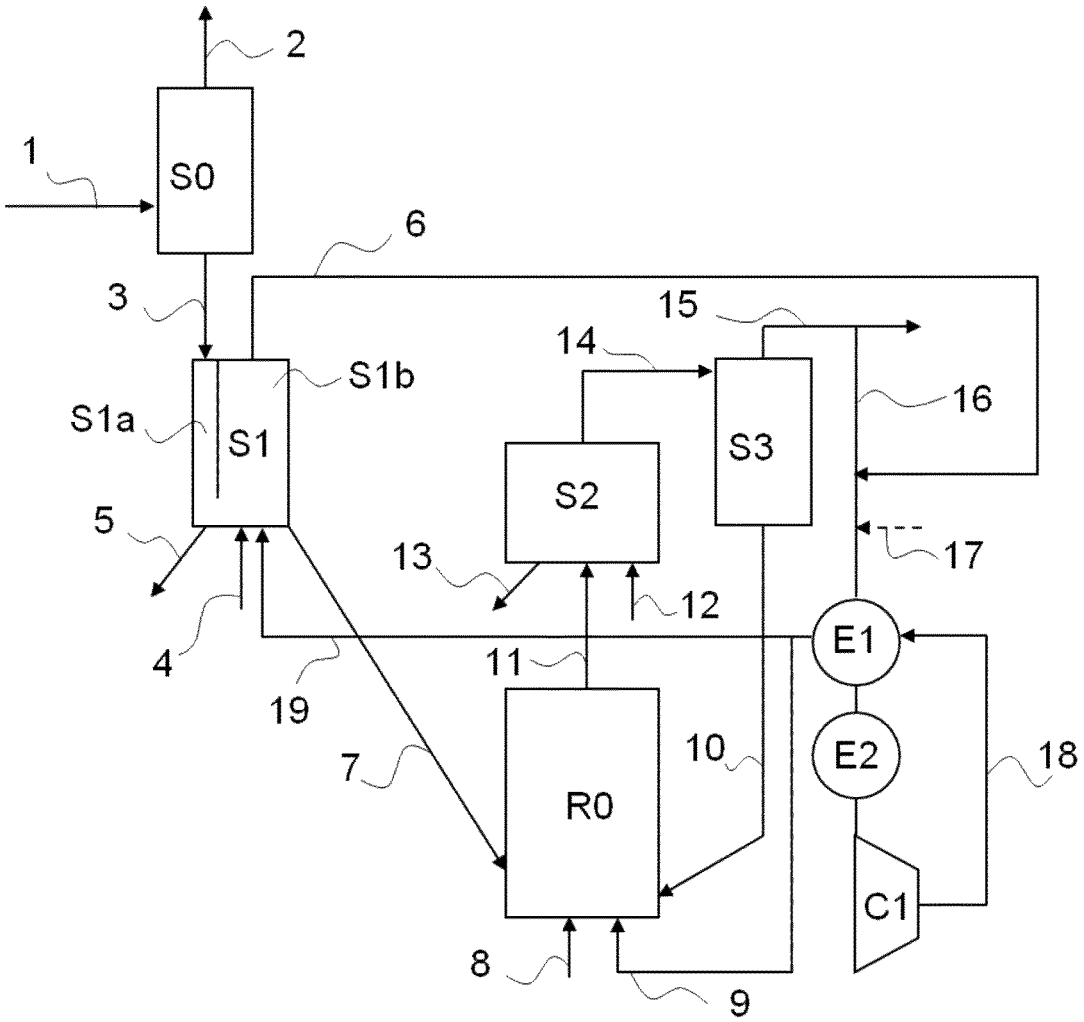
FIG. 2 illustrates the CLC plant and method according to a second embodiment of the invention.

The CLC method and plant according to the invention are notably described hereafter in connection with FIGS. 1 and 2, which schematically show two non-limitative embodiments of the invention.

FIG. 1 is a diagram that illustrates the CLC plant and method according to a first embodiment of the invention. Only part of the CLC plant is shown for the sake of simplification: the oxidation zone is not shown because it is not necessary for better comprehension of the invention, the present invention relating more specifically to the fluidic connection between said oxidation zone and the combustion reactor, and to the operation of the combustion reactor comprising recycling the combustion fumes. The diagram of FIG. 1 is a block diagram wherein for example the locations of the flows in relation to each other do not presuppose their spatial location in an effective CLC plant, unless specifically mentioned in the description.

FIG. 1 shows an embodiment of the invention wherein hydrocarbon feedstock 8 is solid, and selected for example from the list consisting of coal, coke, petcoke, biomass, oil sands and domestic waste. However, the present invention is not limited to the combustion of solid feedstocks. The invention comprises other embodiments more suited to the combustion of gaseous or liquid feedstocks, which do not necessarily comprise all the elements shown in FIG. 1, or which on the contrary comprise elements that are not shown in FIG. 1, but known to those skilled in the art. For example, solid/solid separator S2 is not necessary in case of combustion of gaseous or liquid feedstocks.

The CLC method according to the invention comprises combustion of a hydrocarbon feedstock 8 by contacting it with oxygen carrier 7 in reduction zone R0, and oxidation of the oxygen carrier from reduction zone R0 by contacting it with an oxidizing gas, preferably air, in the oxidation zone (not shown).

According to the invention, oxidized oxygen carrier 3 is sent to at least one sealing device S1 operating in a dual fluidized bed, positioned downstream from the oxidation zone on a transport line carrying the oxygen carrier to said reduction zone R0. Sealing device S1 provides indeed gas sealing between the oxidation zone and the reduction zone. It is a non-mechanical gas sealing device, described in detail hereafter. Oxygen carrier 3 is in its oxidized state as it comes from the oxidation zone. Sealing device S1 is supplied with at least one neutral fluidizing gas 4 so as to form at least a first stream 7 comprising at least part of the oxygen carrier, said stream 7 being sent to reduction zone R0, and a second stream 6 that is gaseous and comprises part of neutral fluidizing gas 4 and gaseous oxygen released by the oxygen carrier.

Gaseous stream 6 containing gaseous oxygen released by the carrier is mixed with a part 16 of combustion fumes 15 so as to form a combustion fumes recycle stream 9 sent at least partly, after being successively cooled, compressed and heated, to reduction zone R0 for the fluidized-bed operation thereof.

Recycling part of the combustion fumes to reduction zone R0 allows this zone to operate in a fluidized bed, without it being necessary to use another fluidizing gas, or at least by reducing the needs for a supplementary fluidizing gas, in particular additional water vapor.

Combustion fumes 15 may contain residual unburned species, which are gaseous species, typically CO and/or $H_2$ and/or $CH_4$, from reduction zone R0. Mixing gaseous stream 6 with a part 16 of said fumes 15 allows in this case to carry out the combustion of said residual unburned species of fumes 15.

Residual unburned species are understood to be the gaseous compounds produced upon incomplete combustion of the feedstock, mainly the unburned gaseous compounds, e.g. CO and/or $H_2$, from the conversion of the feedstock on contact with water (devolatilization/gasification of a solid or liquid feedstock and methane reforming, producing CO and $H_2$) or a fraction of the unconverted gaseous hydrocarbon feedstock, e.g. $CH_4$.

The residual unburned species that may be contained in the fumes are indeed likely to damage compressor C1 used for recycling the combustion fumes to reduction zone R0. The purpose of the recycle compressor is to increase the pressure of the fumes resulting from the combustion, so as to bring them to a sufficient pressure to overcome the pressure drop of the fuel reactor (mainly induced by the fluidized bed and the distributors) and thus be able to feed them to the fuel reactor as fluidizing gas. Thus, the combustion of the residual unburned species by means of the gaseous oxygen recovered from device S1 allows said compressor to be protected without requiring an oxygen stream external to the process, or at least by reducing the need for such an oxygen stream 17 external to the CLC process, thus contributing to limiting the operating costs of the CLC process.

Besides achieving, at least partly, combustion of the residual unburned species that may be contained in the fumes, the gaseous oxygen of gaseous stream 6 mixed with a part 16 of combustion fumes 15 can also participate in the combustion of the feedstock in the reduction zone, if it has not been completely consumed during the combustion of the residual unburned species in the combustion fumes recycle circuit. The gaseous oxygen that may thus remain in combustion fumes recycle stream 9 sent to reduction zone R0 reacts with the hydrocarbon feedstock, thus improving the combustion performances, notably due to the speed of the gas/gas reactions. Besides, since the gaseous oxygen accelerates gasification of the feedstock (gasification is faster with $O_2$ than with $H_2O$), it is possible to reduce the feedstock residence time in the reduction zone, which may result in a smaller dimension of the fuel reactor requiring a smaller volume for the dense bed, and in fine to limit the investment costs for the CLC plant.

In reduction zone R0, oxygen carrier stream 7 from device S1 and hydrocarbon feedstock 8 are thus contacted in a fluidized bed by a fluidizing gas comprising at least part of the conditioned combustion fumes recycle stream 9, also providing gasification of the solid hydrocarbon feedstock.

Reduction zone R0 is so configured that complete combustion of the hydrocarbon feedstock, in particular of the gaseous species of the feedstock, is sought. The combustion fumes thus essentially consist of a mixture of $CO_2$ and $H_2O$. However, the combustion fumes may also contain a small amount of residual unburned species as explained above, notably $CO+H_2$ (syngas), from the reduction zone, formed during the incomplete combustion of part of the feedstock, which may in particular occur when using solid hydrocarbon feedstocks.

Reduction zone R0 can operate in a dense fluidized bed or a circulating fluidized bed, or with a bed layout consisting of a dense phase and a circulating phase. Advantageously, the velocity of the gas in the upper part of reduction zone R0 ranges between 1 m/s and 10 m/s.

A mixture 11 comprising the gases resulting from the combustion (including the possible residual unburned gaseous species) and the oxygen carrier particles, as well as fluidizing gas and solid unburned particles from the unconverted solid feedstock (unburned particles), is discharged at the top of reduction zone R0 and sent to a solid/solid separator S2, fluidized by a fluidizing gas 12, allowing the reduced oxygen carrier to be isolated from the other compounds. In particular, solid/solid separator S2 allows to separate the unburned particles from the oxygen carrier particles. Such a solid/solid separator is known and it is for example described in international patent application WO-2011/151,535. It preferably comprises an enclosure with an inlet pipe for mixture 11 opening into a dilute phase in the upper part of the enclosure, a discharge pipe located in the lower part of the enclosure and an outlet pipe located in the upper part of the enclosure. The inlet and discharge/outlet parameters are so selected as to create in the enclosure a dense phase in the lower part and the dilute phase in the upper part (solid content generally less than 5%, or even less than 1%). In separator S2, the superficial velocity of the gas flow is advantageously greater than the terminal fall velocity of the unburned fuel particles so as to allow entrainment thereof with the gas, thus enabling "fast" separation between the heavy particles (oxygen carrier) and the light particles (unburned particles). A fast separation is understood to be a separation achieved in less than 1 minute and preferably less than 20 seconds, this time corresponding to the residence time of the light particles in the dilute phase of the separator. A stream 13 of reduced oxygen carrier separated in separator S2 is sent to the air reactor, while another stream 14 comprising the other compounds, including the unburned particles, is sent to a gas/solid separator S3, typically a cyclone, allowing the gases to be separated from the unburned particles, and to form a stream 10 of said unburned particles sent to reduction zone R0 for combustion thereof. One or more gas/solid separators can be arranged downstream from separator S3 to achieve more advanced separation.

Mixing gaseous stream 6 with a part 16 of fumes 15 leaving gas/solid separator S3, forming fumes recycle stream 9, is preferably achieved before compression of the recycle stream in compressor C1, so as to burn the residual unburned species, e.g. the syngas, possibly contained in the fumes in order to preserve said compressor, and preferably before cooling the recycle stream before it passes through compressor C1, so as to carry out the combustion under the best temperature conditions.

Advantageously, the gaseous fumes recycle stream 9 is cooled by passing through at least a first heat exchanger E1, then said cooled fumes recycle stream is compressed in compressor C1, and said cooled and compressed combustion fumes recycle stream 18 is heated by passing through heat exchanger E1 prior to being sent at least partly to reduction zone R0.

Preferably, gaseous fumes recycle stream 9 is cooled by passing through a second heat exchanger E2 positioned between first heat exchanger E1 and compressor C1. The purpose of exchanger E2 is to bring the recycled fumes stream to a temperature compatible with the operation of the compressor selected. In this case, it is possible to perform mixing of gaseous stream 6 with part 16 of combustion fumes 15 between first heat exchanger E1 and second heat exchanger E2.

Preferably, fumes recycle stream 9 is cooled to a temperature ranging between 70 °C and 450 °C, preferably between 70 °C and 300 °C, and more preferably between 150 °C and 300 °C, upstream from compressor C1, then compressed to a pressure ranging between 0.02 MPa and 0.3 MPA, and heated to a temperature ranging between 300 °C and 950 °C. Preferably, the maximum temperature reached when heating the compressed fumes is 50 °C lower than the temperature of the mixture of streams 6 and 16, preferably 20 °C lower.

Preferably, the fumes are compressed by compressor C1 to a pressure higher by about 0.03 MPa than that of the reduction zone, notably in order to compensate for the pressure drop of the distributor.

According to the invention, the gaseous oxygen released by the oxygen carrier in sealing device S1 can be sufficient to carry out combustion of the residual unburned species, e.g. CO and/or $H_2$, of part 16 of fumes 15 that will form fumes recycle stream 9. However, an injection of fresh dioxygen 17, oxygen external to the CLC process, can be performed in part 16 of combustion fumes 15 so as to complete the combustion of said residual unburned species carried out with the gaseous oxygen provided by second gaseous stream 6.

Preferably, gaseous stream 6 from sealing device S1 comprises between 1% and 20% by volume of gaseous oxygen, preferably between 1% and 16% by volume, and more preferably between 2% and 16% by volume.

Oxygen carrier 3 sent to sealing device S1 preferably comes from a stream 1 containing the carrier directly coming from the oxidation zone (not shown) and transported by air or another oxidizing gas, preferably containing between 2% and 10% oxygen, and sent to a gas/solid separator S0, typically a cyclone. Gas/solid separator S0 separates the gaseous and solid species into a predominantly gaseous stream 2, consisting of depleted air (or oxygen-depleted oxidizing gas if an oxidizing gas other than air is used in the oxidation zone), and a predominantly solid stream comprising oxidized oxygen carrier 3.

Sealing device S1 can allow to separate the oxygen carrier into two parts: a part forming first stream 7 and a supplementary second part forming a second stream 5, preferably extracted from the bottom of sealing device S1, which is again sent to the oxidation zone. This recycle 5 allows to increase the average residence time of the oxygen carrier in the air reactor by increasing the average number of passes. The desired effect is to maximize the degree of oxidation of the carrier and thus to get close to the theoretical equilibrium determined between the oxygen carrier solid and the partial pressure of oxygen of the gaseous atmosphere at the air reactor outlet. It is thus possible to maximize the degree of oxidation of the oxygen carrier and thereby to maximize its CLOU effect potential.

Sealing device S1 allows to provide maximum gas sealing between the oxidation zone and the reduction zone, while allowing release of the gaseous oxygen of the oxygen carrier forming gaseous stream 6 also containing fluidizing gas 4, preferably extracted through a pipe located in the upper part of sealing device S1. The fluidizing gas 4 used is not air, it essentially consists of water vapor, $CO_2$, for example from a $CO_2$ compression chain downstream from the process, or a mixture of $CO_2$ and water vapor between 0% and 2% by volume of $O_2$, preferably less than 2% by volume of $O_2$. During its stay in device S1, which is not fluidized by air, the oxygen carrier releases a large part of its oxygen by CLOU effect. The partial pressure of oxygen is indeed very low, or even zero, which enables this gaseous oxygen release from the oxygen carrier, under the temperature conditions in device S1, which are close to those of the oxidation and reduction zones, typically, depending on the oxygen carrier and the feedstock selected, between 600 °C and 1200 °C. Preferably, the operating temperature in device S1 is 50 °C lower than the operating temperature in the oxidation zone.

Sealing device S1 and its operation are such that the release of gaseous oxygen by the oxygen carrier is achieved notably through a suitable residence time of the oxygen carrier in sealing device S1. The residence time of the carrier typically ranges between 20 and 900 seconds, preferably between 40 and 300 seconds.

The gas sealing provided by sealing device S1 through fluidization by means of fluidizing gas 4 is important for guaranteeing, on the one hand, the best $CO_2$ capture rate possible and, on the other hand, the highest quality possible for the $CO_2$ captured. Indeed, the oxidizing gas used in the oxidation zone must not contaminate, or as little as possible, the reduction zone. For example, sealing can notably allow to comply with the standards relative to non-condensables in the $CO_2$ stream in the combustion fumes, for transport and/or storage thereof, typically less than 5 mol %.

Sealing device S1 operates in a dual fluidized bed, i.e. it comprises two different fluidized beds within the same device, more precisely two beds operating under different fluidization conditions. Typically, to operate in a dual fluidized bed, the sealing device comprises two communicating zones, each configured to operate in a fluidized bed according to operating conditions specific thereto.

Sealing device S1 preferably comprises an enclosure provided with a first zone Sla and a second zone S1*b* in fluidic communication, the fluidization conditions being different in first and second zones Sla and S1*b* so as to create a distinct fluidized bed in each of the first and second zones. First zone S1*a* receives particles of oxygen carrier 3 from the oxidation zone. Second zone S1*b* receives at least part of the particles of the oxygen carrier from first zone S1*a* that release gaseous oxygen discharged in gaseous stream 6 through an outlet pipe at the top of second zone S1*b*.

Injection of fluidizing gas 4 into sealing device S1 can be performed in form of multiple injections (not shown).

Sealing device S1 may also be a loop seal configured to discharge gaseous stream 6. Such a loop seal comprises a downleg having the same function as first zone Sla, connected, preferably by a substantially horizontal pipe, to an upleg having the same function as zone S1*b*. The upleg comprises a first part in form of a substantially vertical pipe extended by a second part in form of an inclined pipe descending towards the downstream capacity, i.e. the fuel reactor. Loop seal S1 comprises a discharge pipe for the gas, preferably positioned at the top of the first part of the upleg, at the junction with the inclined second part of the upleg. Thus, loop seal S1 allows gaseous stream 6 to be discharged, unlike a conventional loop seal configuration where the upleg would completely carry the mixture consisting of the solid and the gas to the downstream capacity.

FIG. 2 schematically illustrates the CLC plant and method according to a second embodiment of the invention. This second embodiment is identical in every respect to the first embodiment shown in FIG. 1 and described above, except that only part of the combustion fumes recycle stream 9 is sent to reduction zone R0, another part 19, preferably a minor part, being sent, after successive cooling, compression and heating thereof, to sealing device S1 in order to be used as fluidizing gas, in place of or in addition to neutral fluidizing gas 4, preferably in place of it. In particular, fumes recycle gaseous stream 9 is cooled by passing through at least a first heat exchanger E1, and subsequently preferably by passing through a second heat exchanger E2, then said cooled fumes recycle stream is compressed in compressor C1, and said cooled and compressed combustion fumes recycle stream 18 is heated by passing through heat exchanger E1, before a part of it, preferably a major part, is sent to reduction zone R0, and another part 19, preferably a minor part, is sent to sealing device S1.

The CLC plant has been described above alongside the description of the CLC method. It is reminded that it comprises:

- reduction zone R0 configured to operate in a fluidized bed and to perform combustion of the hydrocarbon feedstock through contact with the oxygen carrier in form of particles,
- the oxidation zone (not shown) configured to operate in a fluidized bed and to perform oxidation of the oxygen carrier from reduction zone R0 through contact with an oxidizing gas, preferably air,
- a transport line for carrying the oxygen carrier from the oxidation zone to reduction zone R0, said transport line comprising sealing device S1 configured to operate in a dual fluidized bed by means of a neutral fluidizing gas (4, 19), and to form at least stream 7 comprising at least part of the oxygen carrier sent to reduction zone R0 and gaseous stream 6 comprising part of the neutral fluidizing gas (4, 19) and gaseous dioxygen released by the oxygen carrier, sealing device S1 comprising an outlet pipe for gaseous stream 6,
- a recycle line for part 16 of combustion fumes 15 in reduction zone R0, and the fumes may contain residual unburned species from reduction zone R0, e.g. CO and/or $H_2$ and/or $CH_4$, in said reduction zone R0. The recycle line is connected to the outlet pipe for gaseous stream 6 of sealing device S1 so as to mix gaseous stream 6 with part 16 of combustion fumes 15 and to form a combustion fumes recycle stream 9. The recycle line comprises a cooling, compression and heating system for combustion fumes recycle stream 9 before it is sent to reduction zone R0.

EXAMPLES

The following examples aim to show some performances of the CLC method and plant according to the invention, in particular the reduction in the need for water vapor to ensure fluidization of the reduction zone and the reduction in the need for external dioxygen for combustion of the unburned gases CO and $H_2$ present in the combustion fumes to be recycled.

Example 1

This example relates to the experimental measurement of the oxygen release rate for an example of an oxygen carrier with a CLOU effect.

It implements a batch fluidized bed (the oxygen carrier solid does not circulate) whose temperature can be controlled by an external device such as heating shells, and whose fluidizing gas composition can be controlled so as to alternately supply the reactor with an oxidizing, inert or reducing atmosphere. The gaseous effluents are collected and a sample is analyzed by gas chromatography. The operation is done in cycles with a temperature setpoint kept constant in each phase.

The first phase of the cycle consists in fluidizing the reactor with an oxidizing gas (mixture of $N_2/O_2$ with 20% by volume of $O_2$). The end of this cycle is characterized by a downstream $O_2$ content equal to the content upstream from the reactor, indicating complete oxidation of the material.

The second phase consists in fluidizing the reactor with an inert atmosphere. It is during this phase that the CLOU effect is measured. The end of this cycle is characterized by an $O_2$ content tending to zero, i.e. depletion of the CLOU effect.

The third phase consists in fluidizing the reactor with a reducing atmosphere, typically methane $CH_4$. The goal is to deplete the residual oxygen contained in the structure of the oxygen carrier. The end of the cycle is the measurement of a reducing species content at the outlet equal to that measured at the inlet.

After a new inerting phase in order not to mix the oxidizing and reducing atmospheres, a new cycle can be started.

We describe here the monitoring of a material during the second phase of the cycle.

The oxygen carrier based on manganese oxide is exposed to air until complete oxidation at 940 °C, then it is abruptly exposed to a neutral atmosphere by sweeping with pure nitrogen, and the oxygen release profile is recorded as a function of time. The oxygen carrier is a natural manganese ore, pyrolusite, which is a natural variety of manganese dioxide, $MnO_2$, also known as manganese (IV) oxide. The redox pair is $Mn_2O_3/Mn_3O_4$, and the carrier particles have a size of between 150 μm and 300 μm.

The results are shown in FIG. 3. The x-axis represents time (in seconds), and the y-axis the flow of $O_2$ per kg of oxygen carrier (in mol/kg/s), the oxygen carrier is first exposed to air until complete oxidation at 940 °C. It is then abruptly exposed to a neutral atmosphere by sweeping with pure nitrogen, and the oxygen release profile is recorded as a function of time.

Example 2 (Comparative)

An example of a pilot CLC plant, supplied with petcoke as solid fuel, is fed with an oxygen carrier based on manganese oxide as described in example 1. This oxygen carrier exhibits a CLOU effect.

The pilot CLC plant according to this example 2 is similar to that shown in FIG. 1, except that it is not configured to exploit the gaseous oxygen released by the oxygen carrier by CLOU effect in sealing device S1 and to achieve mixing of stream 6 with the part of the fumes to be recycled; it has no connection between sealing device S1 and the recycle line for part 16 of combustion fumes 15. Elements S0, S2, S3 are not detailed in the present example.

In this example of a 3-MW pilot CLC plant, the estimated residence time of the oxygen carrier in sealing device S1 is 160 s. By integrating the oxygen release profiles as a function of the residence time, it is thus possible to estimate a total amount of oxygen released in sealing device S1.

The gaseous stream at the outlet of sealing device S1 operating in a dual fluidized bed is combined with the main depleted air stream leaving the air reactor. The composition of the combination of these two streams is given in Table 1 hereafter:

TABLE 1

| Composition in mol % | |
|---|---|
| $H_2$ | 0.0% |
| $H_2O$ | 8.7% |
| CO | 0.0% |
| $CO_2$ | 1.8% |
| $CH_4$ | 0.0% |
| $O_2$ | 2.7% |
| $N_2$ | 86.8% |
| SOx | 0.0% |
| NOx | 0.0% |

In the chemical composition tables given in this example, the values are rounded to one decimal place.

The fumes at the outlet of fuel reactor R0 are partly recycled to serve as fluidizing gas 9 injected into the fuel reactor.

The composition of the fumes at the fuel reactor outlet is given in Table 2 below:

TABLE 2

| Composition in mol % | |
|---|---|
| $H_2$ | 1.0% |
| $H_2O$ | 43.6% |
| CO | 1.0% |
| $CO_2$ | 53.4% |
| $CH_4$ | 0.0% |
| $O_2$ | 0.0% |
| $N_2$ | 0.4% |
| SOx | 0.2% |
| NOx | 0.3% |

Since these fumes contain unburned gases CO and $H_2$, air or oxygen combustion, also referred to as air or oxygen polishing, is necessary to burn these gases.

The portion of fumes leaving the fuel reactor at 950 °C, which is intended to be recycled to the fuel reactor as fluidizing gas, is a stream with a flow rate of 1690 $Nm^3/h$ that must be mixed with a pure oxygen stream external to the CLC process so as to completely burn the CO and $H_2$ compounds present.

The pure $O_2$ flow necessary to eliminate the CO and $H_2$ is 17 $Nm^3/h$.

Downstream from the mixing zone with the external pure $O_2$ stream, the stream is cooled down to 150 °C by successive exchange with the cooled fumes, then with cooling water tubes. The fumes stream has the composition given in Table 3 hereafter (identical composition before and after cooling):

TABLE 3

| Composition in mol % | |
|---|---|
| $H_2$ | 0.0% |
| $H_2O$ | 44.7% |
| CO | 0.0% |
| $CO_2$ | 54.5% |
| $CH_4$ | 0.0% |
| $O_2$ | 0.0% |
| $N_2$ | 0.4% |
| SOx | 0.2% |
| NOx | 0.3% |

This cooled fumes stream passes through a recycle compressor and it is subsequently heated to a temperature of 300 °C by exchange with the hot fumes stream, then injected into the fuel reactor, after mixing with 135 kg/h water vapor. The composition of the gas injected into the fuel reactor is given in Table 4 hereafter:

TABLE 4

| Composition in mol % | |
|---|---|
| $H_2$ | 0.0% |
| $H_2O$ | 49.6% |
| CO | 0.0% |
| $CO_2$ | 49.5% |
| $CH_4$ | 0.0% |
| $O_2$ | 0.0% |
| $N_2$ | 0.3% |
| SOx | 0.2% |
| NOx | 0.3% |

Example 3 (According to the Invention)

Another example of a pilot CLC plant, supplied with petcoke as solid fuel, is fed with an oxygen carrier based on manganese oxide as described in example 1. This oxygen carrier exhibits a CLOU effect.

The pilot CLC plant according to example 3 is similar to that of FIG. 1, and it is configured to exploit the gaseous oxygen released by the oxygen carrier by CLOU effect in sealing device S1, and to achieve mixing of stream 6 with the part of the fumes to be recycled. Elements S0, S2, S3 are not detailed in the present example.

Unlike example 2, the gaseous stream at the outlet of sealing device S1 operating in a dual fluidized bed is not combined with the main depleted air stream leaving the air reactor, but it is mixed with part of the fumes stream leaving the fuel reactor.

The composition of the depleted air at the air reactor outlet is given in Table 5 hereafter:

TABLE 5

| Composition in mol % | |
|---|---|
| $H_2$ | 0.0% |
| $H_2O$ | 0.1% |
| CO | 0.0% |
| $CO_2$ | 2.0% |
| $CH_4$ | 0.0% |

TABLE 5-continued

| Composition in mol % | |
|---|---|
| $O_2$ | 2.3% |
| $N_2$ | 95.5% |
| SOx | 0.0% |
| NOx | 0.0% |

The composition of the fumes at the fuel reactor outlet is given in Table 6 below:

TABLE 6

| Composition in mol % | |
|---|---|
| $H_2$ | 1.0% |
| $H_2O$ | 43.6% |
| CO | 1.0% |
| $CO_2$ | 53.4% |
| $CH_4$ | 0.0% |
| $O_2$ | 0.0% |
| $N_2$ | 0.4% |
| SOx | 0.2% |
| NOx | 0.3% |

The portion of fumes leaving the fuel reactor at 950 °C, which is intended to be recycled to the fuel reactor as fluidizing gas 9, is a stream with a flow rate of 1550 $Nm^3/h$.

Mixing this fumes stream with the gaseous stream with a flow rate of 230 $Nm^3/h$, leaving sealing device S1 at 1000 °C, causes combustion of the compounds CO and $H_2$ present in the fumes.

A pure $O_2$ stream external to the CLC process, with a flow rate of 1 $Nm^3/h$, has to be injected in order to completely eliminate the residual compounds CO and $H_2$.

Downstream from the mixing zone with the gaseous stream from sealing device S1 and the external pure $O_2$ stream, the fumes stream is cooled down to 150 °C by successive exchange with the cooled fumes, then with cooling water tubes, and it has the composition given in Table 7 hereafter:

TABLE 7

| Composition in mol % | |
|---|---|
| $H_2$ | 0.0% |
| $H_2O$ | 49.7% |
| CO | 0.0% |
| $CO_2$ | 49.7% |
| $CH_4$ | 0.0% |
| $O_2$ | 0.0% |
| $N_2$ | 0.3% |
| SOx | 0.2% |
| NOx | 0.2% |

This cooled fumes stream passes through a recycle compressor and it is subsequently heated to a temperature of 300 °C by exchange with the hot fumes stream, then injected into the fuel reactor. It has the required composition in terms of water vapor concentration, it is therefore not necessary to add a water vapor stream prior to injecting it into the bottom of the fuel reactor.

The operation of the chemical looping combustion according to the invention thus allows to reduce the cost of the process significantly through the reduction in or even the absence of additional water vapor and the flow rate reduction of the pure oxygen external to the CLC process used for combustion of the unburned gases CO and $H_2$ in the combustion fumes to be recycled. Table 8 hereafter compares these various flow rates during the operation according to example 2 and according to example 3:

TABLE 8

| | Additional flow of vapor to be injected into the bottom of the fuel reactor (kg/h) | Flow of pure oxygen for burning CO and $H_2$ ($Nm^3/h$) |
|---|---|---|
| Example 2 (comparative) | 135 | 17 |
| Example 3 (according to the invention) | 0 | 1 |

The invention claimed is:

1. A method for combustion of a hydrocarbon feedstock (8) by redox-based chemical looping combustion, wherein a redox active mass in form of particles circulates between an oxidation zone and a reduction zone (R0) operating in a fluidized bed, comprising:

combustion of said hydrocarbon feedstock (8) through contact with said redox active mass in reduction zone (R0), oxidation of said redox active mass from said reduction zone (R0) through contact with an oxidizing gas in said oxidation zone, feeding said oxidized redox active mass into at least one sealing device (S1) operating in a dual fluidized bed, positioned downstream from said oxidation zone on a transport line carrying said redox active mass to said reduction zone (R0), said sealing device being supplied with at least one neutral fluidizing gas (4, 19), so as to form at least a first stream (7) comprising at least part of said redox active mass sent to said reduction zone (R0), and a second gaseous stream (6) comprising part of said neutral fluidizing gas (4) and gaseous dioxygen released by said redox active mass, mixing said second gaseous stream (6) with part (16) of combustion fumes (15) so as to form a combustion fumes recycle stream (9) sent at least partly, after being successively cooled, compressed and heated, to said reduction zone (R0) for the fluidized bed operation thereof.

2. A method as claimed in claim 1, wherein part (16) of combustion fumes (15) contains residual unburned species from reduction zone (R0), and wherein combustion of said residual unburned species is carried out on contact with the gaseous dioxygen provided by the mixture of said second gaseous stream (6) with part (16) of combustion fumes (15).

3. A method as claimed in claim 2, further comprising injecting fresh dioxygen (17) into said part (16) of combustion fumes (15) to complete the combustion of said residual unburned species.

4. A method as claimed in claim 1, comprising sending part (19) of said combustion fumes recycle stream (9), after successive cooling, compression and heating thereof, into said sealing device (S1) for the fluidized-bed operation of said sealing device (S1).

5. A method as claimed in claim 1, wherein said gaseous recycle stream (9) is cooled by passing through at least a first heat exchanger (E1), then said cooled combustion fumes recycle stream is compressed in a compressor (C1), and said cooled and compressed combustion fumes recycle stream is heated by passing through said first heat exchanger (E1) prior to being sent at least partly to reduction zone (R0).

6. A method as claimed in claim 5, wherein said combustion fumes recycle stream (9) is cooled by passing through a second heat exchanger (E2) positioned between first heat exchanger (E1) and compressor (C1).

7. A method as claimed in claim 5, wherein said combustion fumes recycle stream (9) is cooled to a temperature ranging between 70 °C and 450 °C, then compressed to a pressure ranging between 0.02 MPa and 0.3 MPa, and heated to a temperature ranging between 300 °C and 950 °C.

8. A method as claimed claim 1, wherein said second gaseous stream (6) from said sealing device (S1) comprises between 1% and 20% by volume of gaseous dioxygen.

9. A method as claimed in claim 1, wherein said redox active mass comprises at least one compound selected from the group consisting of copper oxides, cobalt oxides, manganese oxides, mixed cobalt-iron oxides, manganese-iron oxides, and mixtures thereof.

10. A method as claimed in claim 1, wherein said neutral fluidizing gas (4, 19) sent to said sealing device (S1) is essentially made up of water vapor, $CO_2$, or a mixture of $CO_2$ and water vapor comprising between 0 and 2% by volume of $O_2$.

11. A method as claimed in claim 1, wherein said sealing device (S1) comprises an enclosure provided with a first zone (S1*a*) and a second zone (S1*b*) in fluidic communication, the fluidization conditions being different in said first and second zones, so as to create a distinct fluidized bed in each of the first and second zones, said first zone (S1*a*) receiving redox active mass particles from the oxidation reactor, and said second zone (S1*b*) receiving at least part of said redox active mass particles from said first zone (S1*a*) that release gaseous dioxygen discharged in said second gaseous stream (6) through an outlet pipe arranged at the top of said second zone (S1*b*).

12. A method as claimed in claim 11, wherein a third stream (5) comprising part of said redox active mass is formed and extracted from said bottom of said sealing device (S1) in order to be again sent to said oxidation zone.

13. A method as claimed in claim 1, wherein said redox active mass sent to said sealing device (S1) is first separated from the oxygen-depleted oxidizing gas from the oxidation zone in a cyclone (S0) positioned between said oxidation zone and said sealing device (S1).

14. A method as claimed in claim 1, wherein said hydrocarbon feedstock (8) is a solid feedstock in form of particles, said method further comprising:

separation, in a fluidized-bed solid/solid separator (S2) positioned at the outlet of reduction zone (R0), between the particles of said redox active mass and unburned particles generated by the combustion of said solid hydrocarbon feedstock (8) contained in a first gas-solid mixture (11) from said reduction zone (R0), said solid/solid separator operating in a fluidized bed, then separation, in a gas/solid separator (S3) positioned downstream from said solid/solid separator (S2), between the unburned particles and the gas phase contained in a second gas-solid mixture (14) from solid/solid separator (S2), a stream (10) comprising said unburned particles, and said gas phase forming combustion fumes (15).

15. A plant for implementing the method for combustion of a hydrocarbon feedstock by redox-based chemical looping combustion as claimed in claim 1, comprising:

a reduction zone (R0) configured to operate in a fluidized bed and to perform combustion of said hydrocarbon feedstock through contact with a redox active mass in form of particles, an oxidation zone configured to operate in a fluidized bed and to perform oxidation of said redox active mass from said reduction zone (R0) through contact with an oxidizing gas, a transport line for carrying said redox active mass from said oxidation zone to said reduction zone (R0), said transport line comprising a sealing device (S1) configured to operate in a dual fluidized bed by means of a neutral fluidizing gas (4, 19), and to form at least a first stream (7) comprising at least part of said redox active mass sent to said reduction zone (R0) and a second gaseous stream (6) comprising part of said neutral fluidizing gas (4, 19) and gaseous dioxygen released by said redox active mass, said sealing device (S1) comprising an outlet pipe for said second gaseous stream (6), a recycle line for part (16) of combustion fumes (15) in said reduction zone (R0), said recycle line being connected to said outlet pipe for said second gaseous stream (6) of sealing device (S1) so as to mix said second gaseous stream (6) with said part (16) of combustion fumes (15) and to form a combustion fumes recycle stream (9), and said recycle line comprising a cooling, compression and heating system for said combustion fumes recycle stream (9) before it is sent to said reduction zone (R0).

16. A method as claimed in claim 1, wherein the oxidizing gas is air.

17. A method as claimed in claim 7, wherein said combustion fumes recycle stream (9) is cooled to a temperature ranging between 70 °C and 300 °C.

18. A method as claimed in claim 1, wherein said redox active mass comprises at least one compound selected from the group consisting of copper oxides, cobalt oxides, manganese oxides, mixed cobalt-iron oxides, manganese-iron oxides, and mixtures thereof, in form of spinels or perovskites, which are associated with an alumina, silica, silica-alumina or feldspar support.

19. A method as claimed in claim 14, wherein said hydrocarbon feedstock (8) is a solid feedstock in form of particles selected from the group consisting of coal, coke, petcoke, biomass, oil sands and domestic waste.

20. A method as claimed in claim 14, wherein stream (10) comprising said unburned particles is sent to said reduction zone (R0).

* * * * *